US005441237A

United States Patent [19]

Sweeney

[11] Patent Number: 5,441,237

[45] Date of Patent: Aug. 15, 1995

[54] PNEUMATIC VEHICLE JACK

[76] Inventor: Charles F. Sweeney, 921 Merrick Ave., Haddon Township, N.J. 08108

[21] Appl. No.: 281,625

[22] Filed: Jul. 28, 1994

[51] Int. Cl.[6] ..... B66F 3/24

[52] U.S. Cl. ..... 254/93 HP

[58] Field of Search ..... 254/93 HP, 93 H, 423

[56] References Cited

U.S. PATENT DOCUMENTS 1,590,830 6/1926 Jewkes ..... 254/93 HP
2,610,824 9/1952 Grier ..... 254/93 HP
2,938,570 5/1960 Flajole ..... 254/93 HP
4,925,158 5/1990 Yang ..... 254/93 H

*Primary Examiner*—Robert C. Watson

[57] ABSTRACT

A jack structure wherein a rigid housing includes a plurality of stacked pneumatic bags within the housing, wherein the stacked pneumatic bags are arranged for selective inflation by use of a pneumatic compressor that in turn is operative through an electrical supply line that is arranged to receive electrical energy from the cigarette lighter or have clips to attach to positive and negative posts of car battery of an associated vehicle. A valve assembly permits selective inflation and deflation of the pneumatic bag structure within the housing.

4 Claims, 4 Drawing Sheets

PNEUMATIC VEHICLE JACK

TECHNICAL FIELD

The field of invention relates to pneumatic jack structure, and more particularly pertains to a new and improved pneumatic vehicle jack wherein the same employs stacked pneumatic flexible chambers positioned within a housing permitting the housing to effect lifting of an associated vehicle.

BACKGROUND OF THE INVENTION

Pneumatic jack structure of various types have been employed in the prior art as exemplified by the U.S. Pat. Nos. 4,542,882; 5,121,900; 5,184,930; 3,993,286; and 5,232,206.

The jack structure of the prior art has heretofore been of a relatively complex structure as in the manner of U.S. Pat. No. 4,542,882 a bag arranged to receive pressurized air from an exhaust system into a single flexible bag structure.

SUMMARY OF THE INVENTION

The present invention relates to pneumatic jack structure and as a specific invention presented herewithin sets forth a housing containing spaced pneumatic bags to permit the stacked bags to inflate and direct the housing against an overlying vehicle, that in turn is engaged by a support plate mounted to a top wall of the housing. A check valve that is selectively released to permit deflation of the pneumatic bags is provided, with an air compressor arranged for receiving energy through the associated vehicle's electrical supply system.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
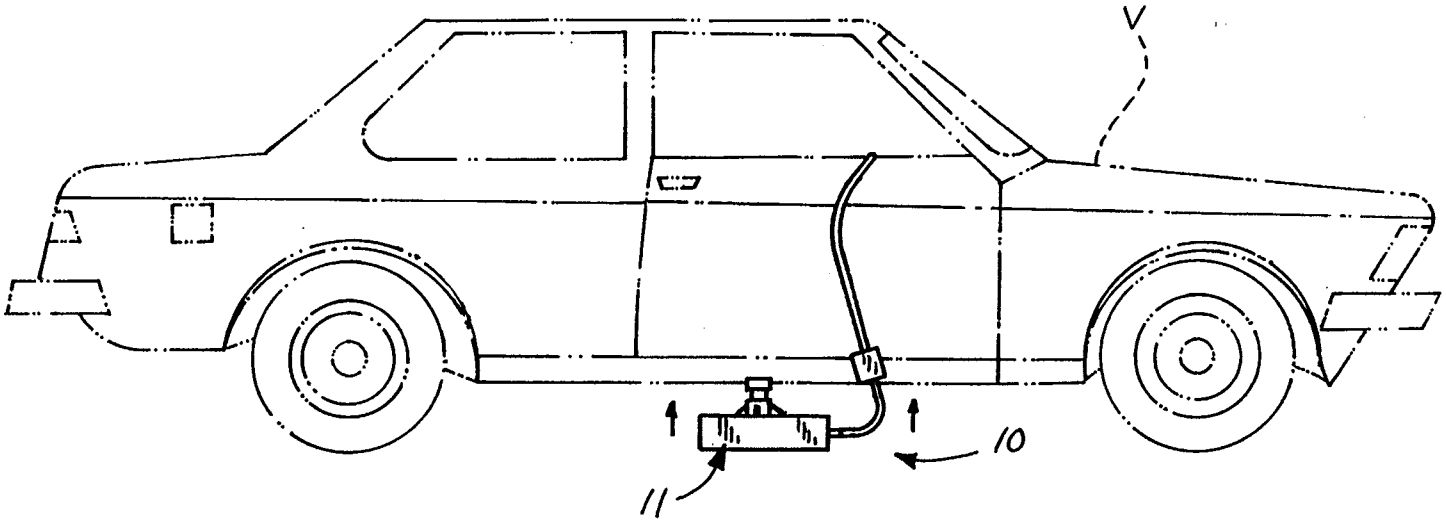
FIG. 1 is an orthographic view of the invention in operative communication with an associated vehicle.
Figure 2:
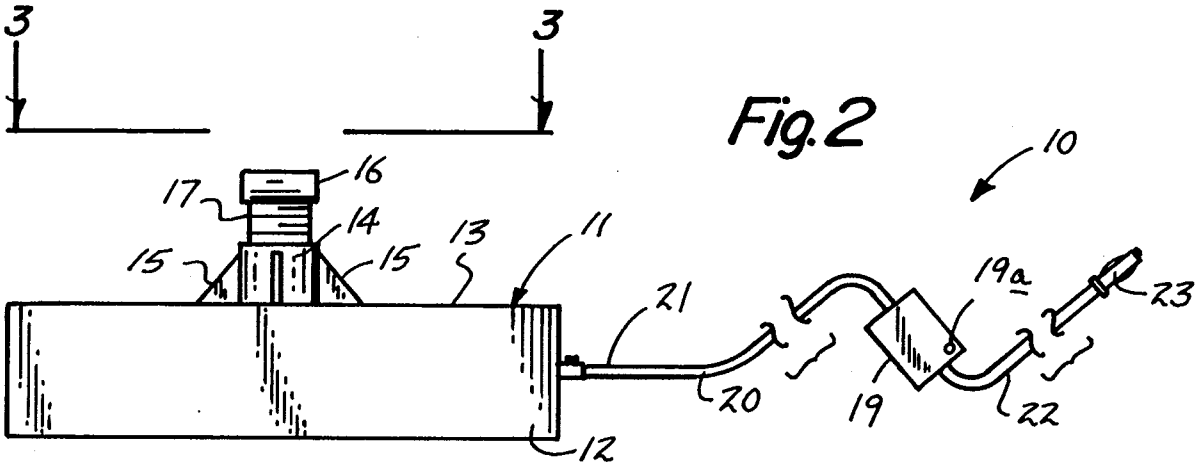
FIG. 2 is an enlarged orthographic view of the invention.
Figure 3:
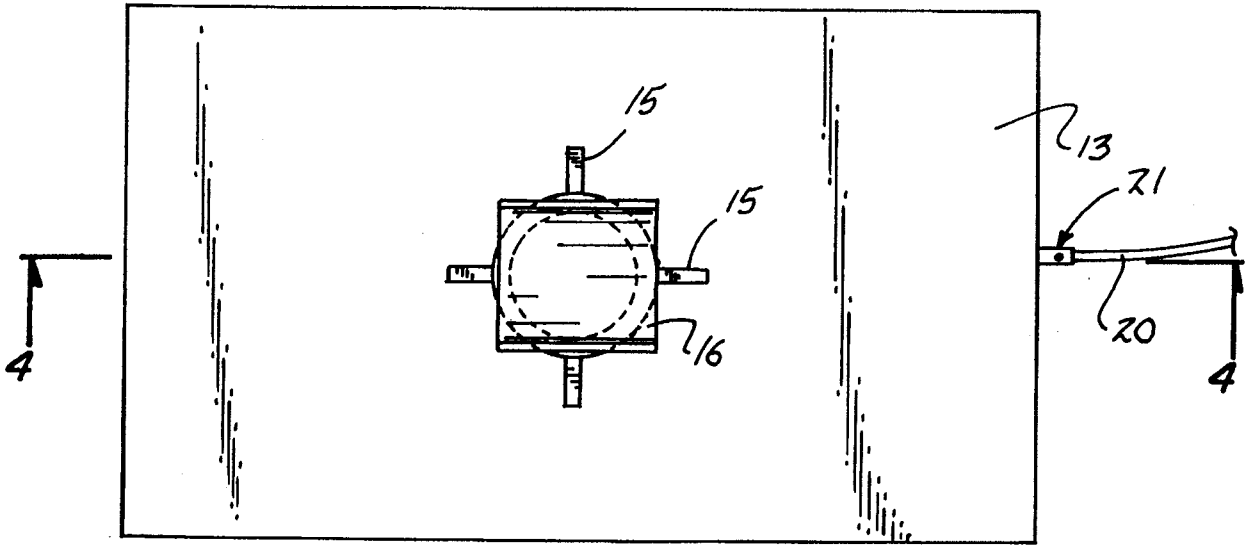
FIG. 3 is an orthographic view, taken along the lines 3—3 of FIG. 2 in the direction indicated by the arrows.
Figure 4:
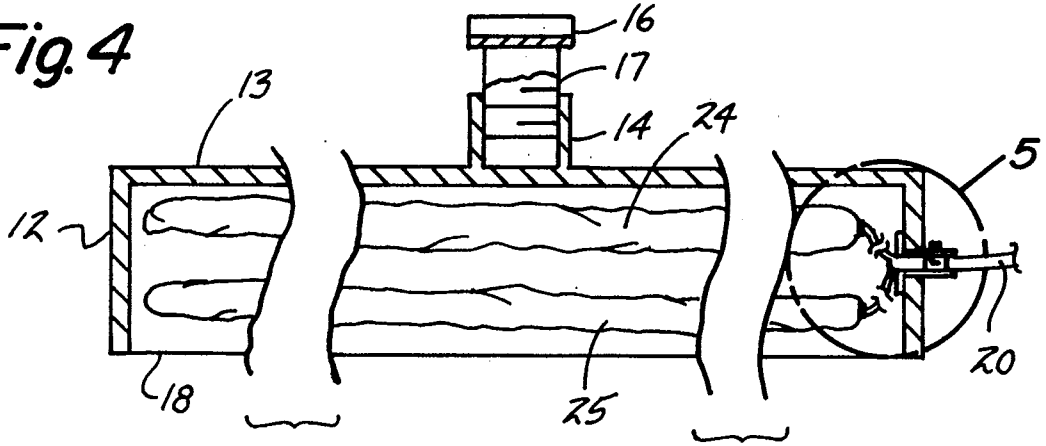
FIG. 4 is an orthographic view, taken along the lines 4—4 of FIG. 3 in the direction indicated by the arrows.

The invention of the pneumatic vehicle jack 10 as indicated in FIG. 1 is arranged for positioning below an associated vehicle "V", such that upon actuation of the invention the vehicle is lifted permitting access below the vehicle and to various activities such as tire changing and the like. To this end, a rigid housing 11 is provided having a continuous side wall 12 and a top wall 3. Orthogonally mounted to the top wall 13 is a support tube 14 employing gussets 15 to insure rigid securement and continuous operation of the device in use. A support plate 6 is provided. The support plate may be of a generally U-shaped configuration for receiving the vehicle, as indicated in FIG. 1, but it is in turn fixedly and orthogonally secured to a plate tube 17 that is exemplified in FIG. 4 and threadedly received within the support tube 14. A first and second pneumatic bag 24 and 25 respectively, as illustrated in FIG. 4, are positioned within the housing and upon inflation projected through to the housing through the housing's floor opening 18 that is oriented below the housing top wall 13. A pneumatic compressor 19 is provided having a pneumatic conduit 20 directed form the pneumatic compressor 19 to a valve assembly 21 that directs pneumatic pressurized air to the first and second pneumatic bags 24 and 25 through respective first and second bag conduits 26 and 27 (see FIG. 5). An electrical power supply cord 22 is directed to the pneumatic compressor 19, with an electrical plug 23 provided to be received within the vehicle's cigarette lighter socket that is per se known in the prior art to permit ease of driving electrical power from the vehicle's electrical system.

Figure 5:
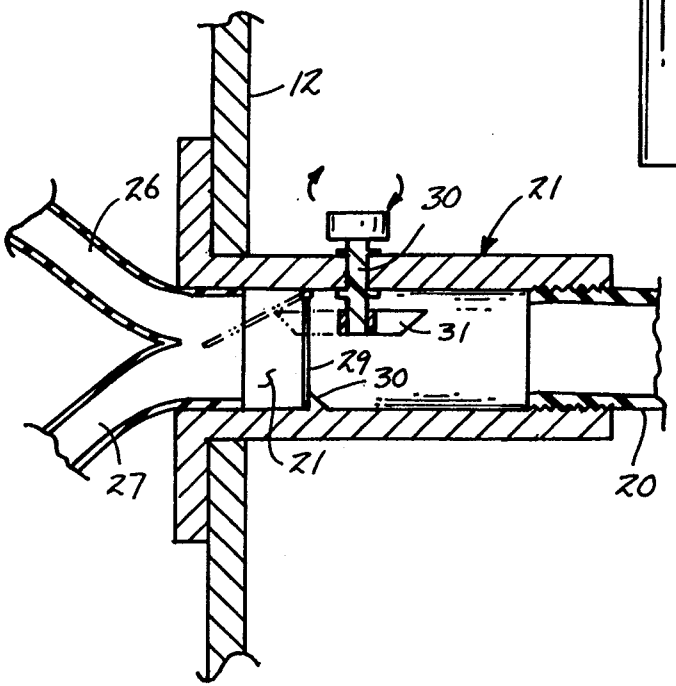
FIG. 5 is an enlarged orthographic view of section 5 as set forth in FIG. 4.

The FIG. 5 indicates the check valve employed having a check valve plate 29 pivotally mounted within the valve assembly's conduit 21*a*. To prevent pressurized air from being directed from the first and second bags 26 and 27 back through the valve assembly 21 to the pneumatic conduit 20 is a plate abutment 30 positioned within the valve assembly conduit 21*a* between the plate 29 ,and the pneumatic conduit 20. In this manner, pressurized air from the first and second pneumatic bags 24 and 25 engages the plate 29 preventing such pressurized air to leave the first and second bag members 24 and 25. To permit release of air from the first and second pneumatic bags 24 and 25, a rotary release shaft 30 is provided positioned between the plate 29 and the pneumatic conduit 20, such that the rotary release shaft 30 is spaced from the plate 29 a predetermined length. A shaft foot 31 is fixedly and orthogonally mounted to the release shaft 30, having a foot length greater than the predetermined length such that upon rotation of the release shaft 30, the shaft foot 31 engages the plate 29 and displaces the plate relative to the abutment 30, such as indicated in phantom in FIG. 5, to permit pressurized air to be released from the first and second bags through the conduit 20 for ultimate release through a relief opening 19*a* within the compressor 19.

Figure 6:
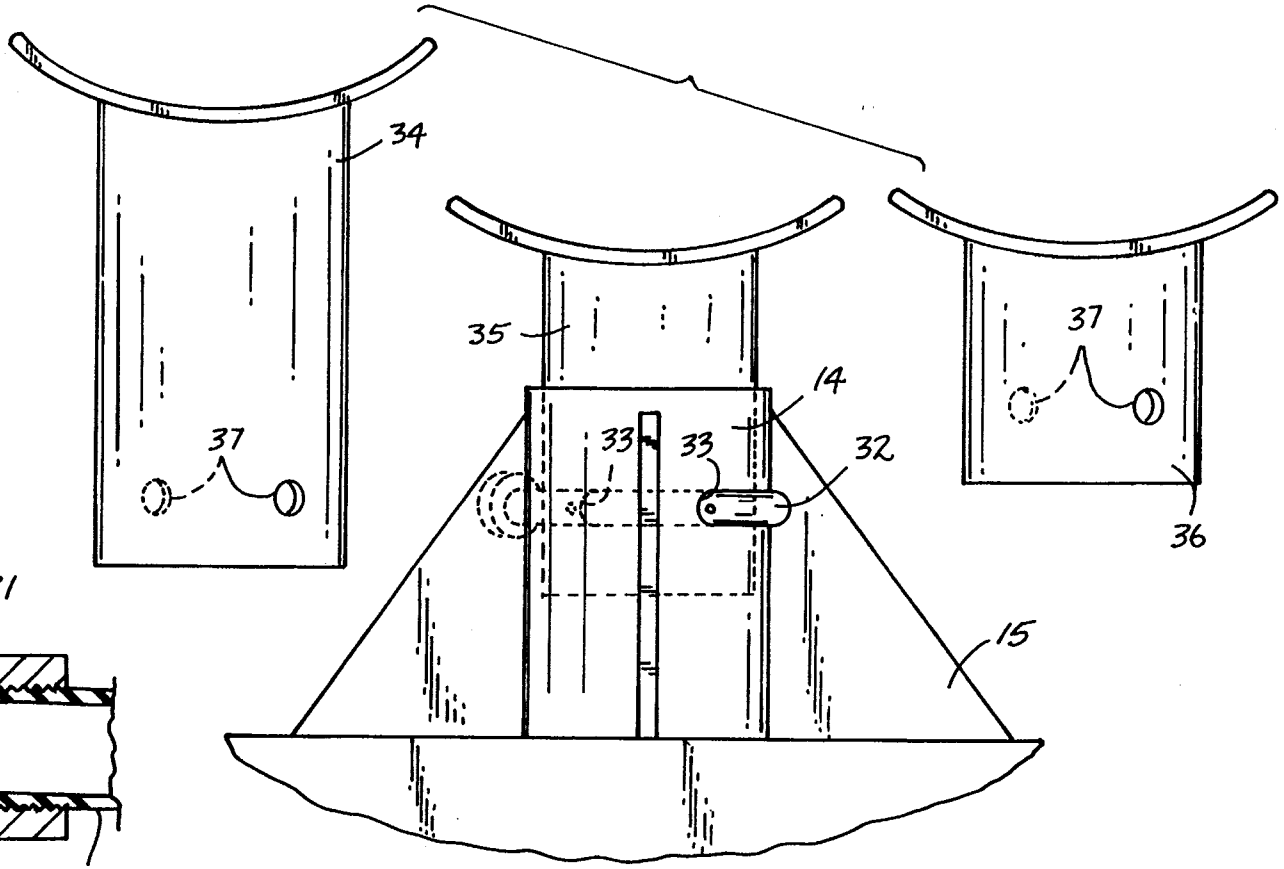
FIG. 6 is an orthographic view of a plurality of plate tubes employed by the invention.

The FIG. 6 indicates the use of the support tube 14 having aligned tube bores 33 to receive a lock pin 32, that in turn is received through replacement plate support tubes defined by a first, second, and third plate tube 34, 35, and 36 respectively, with the first plate tube 34 having a first length, the second plate tube 35 having a second length less than the first length, and the third plate tube 36 having a third length less than the second length to provide for accommodation of vehicles of varying ground clearance, with each of the plate tubes 34–36 having respective aligned bores 37 for selective mounting within the support tube 14 in lieu of the primary plate tube 17 that is threadedly received within the support tube 14.

Figure 7:
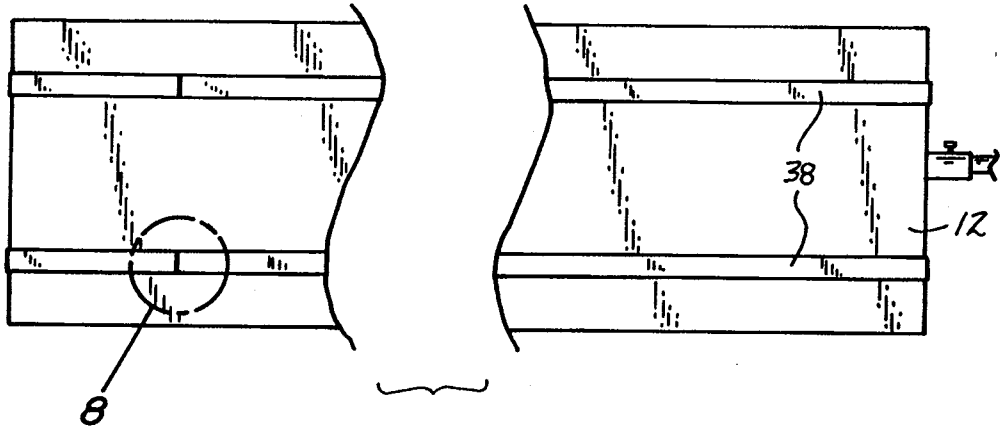
FIG. 7 is an orthographic view of the invention employing associated reflective tape.
Figure 8:
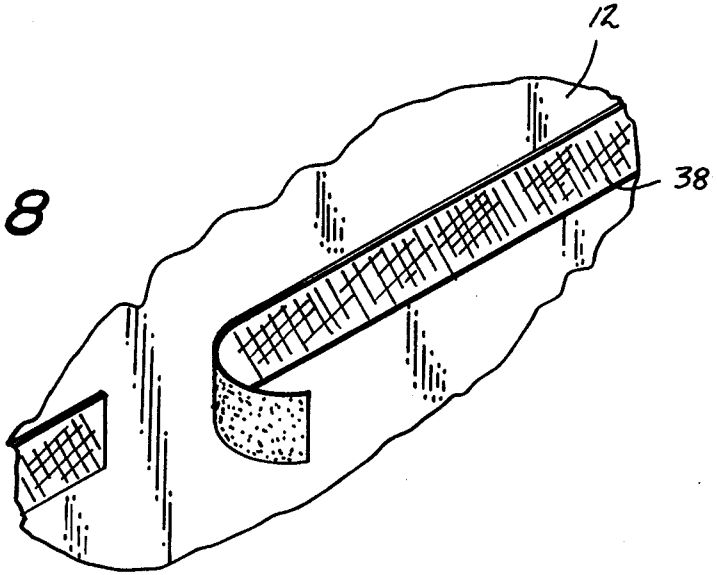
FIG. 8 is an enlarged isometric illustration of section 8 as set forth in FIG. 7.

The FIGS. 7 and g indicates the optional employment of reflective tape 38 that is adhesively mounted to the housing's side wall 12.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A pneumatic vehicle jack, comprising, a rigid housing, the housing having a continuous side wall, a top wall, and a housing floor opening positioned in a facing relationship relative to the housing top wall, with a least one pneumatic bag positioned within the housing between the housing floor opening and the housing top wall, and a compressor, and power supply means directed to the compressor for effecting actuation of the compressor, and a pneumatic conduit directed from the compressor to a valve assembly, the valve assembly directing pressurized air from the compressor through the pneumatic conduit to the at least one pneumatic bag, and a support tube fixedly and orthogonally mounted to the housing top wall, with a plate tube adjustably received within the support tube;

the valve assembly includes a valve conduit directed therethrough in pneumatic communication with the at least one pneumatic bag and the pneumatic conduit, and a plate pivotally mounted within the valve assembly conduit, and a plate abutment fixedly mounted within the valve assembly conduit oriented between the plate and the pneumatic conduit.

2. A jack as set forth in claim 1 including a rotary relief shaft rotatably received within the valve assembly and extending into the valve assembly conduit, with the rotary release shaft having a shaft foot fixedly mounted to the rotary relief shaft within the valve assembly conduit, the plate spaced from the rotary shaft a predetermined length, and the shaft foot having a foot length greater than said predetermined length to permit displacement of the plate from the abutment to displace the plate from the abutment permitting selectively deflation of the at least one pneumatic bag.

3. A jack as set forth in claim 2 wherein the support tube threadedly receives the plate tube, and the support tube having aligned tube bores, and further including a first plate tube and a second plate tube, the first plate tube having a first length, the second plate tube having a second length greater than the first length, and the first plate tube and the second plate tube having respective aligned plate tube bores and a lock pin, wherein the first plate tube and the second plate tube are each selectively received within the support tube in a slidable relationship, and the lock pin is arranged for reception through the aligned tube bores and the aligned plate tube bores of one of said first plate tube and said second plate tube upon positioning of said first plate tube or said second plate tube within the support tube.

4. A jack as set forth in claim 3 wherein the housing side wall includes reflective tape adhesively mounted to the housing side wall, and at least one gusset fixedly securing the support tube to the housing top wall.

* * * * *